US009252507B2

(12) United States Patent
Nagasaki et al.

(10) Patent No.: US 9,252,507 B2
(45) Date of Patent: Feb. 2, 2016

(54) TERMINAL BLOCK

(71) Applicant: Tyco Electronics Japan G.K., Kanagawa (JP)

(72) Inventors: Taisuke Nagasaki, Kanagawa (JP); Keita Terajima, Kanagawa (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/503,947

(22) Filed: Oct. 1, 2014

(65) Prior Publication Data

US 2015/0093943 A1 Apr. 2, 2015

(30) Foreign Application Priority Data

Oct. 1, 2013 (JP) ..... 2013-206345

(51) Int. Cl.
*H01R 4/48* (2006.01)
*H01R 13/193* (2006.01)

(52) U.S. Cl.
CPC ..... *H01R 4/4818* (2013.01); *H01R 13/193* (2013.01)

(58) Field of Classification Search
CPC .. H01R 4/4818; H01R 13/193; H01R 4/4872; H01R 11/22; H01R 13/187; H01R 13/113; H01R 4/48; H01R 4/38; H01R 4/34; H01R 11/12; H01R 4/36; H01R 4/30; H01R 11/11; H01R 4/489
USPC ..... 439/817–818; 438/815, 835
See application file for complete search history.

(56) References Cited

U.S. PATENT DOCUMENTS 6,146,187 A * 11/2000 Pallai ..... H01R 4/4836 439/431
6,689,955 B2 * 2/2004 Doutaz ..... H01R 4/4836 174/135
7,097,518 B2 * 8/2006 Kraemer ..... H01R 4/40 439/806
8,727,819 B2 * 5/2014 Giefers ..... H01R 4/489 439/441
8,734,192 B2 * 5/2014 He ..... H01R 4/489 439/815

FOREIGN PATENT DOCUMENTS

| | | | |
|---|---|---|---|
| JP | 5-129039 | A | 5/1993 |
| JP | 8-64266 | A | 3/1996 |
| JP | 2000-306617 | A | 11/2000 |
| JP | 2001-135372 | A | 5/2001 |
| JP | 2007-165323 | A | 6/2007 |
| JP | 2008-53238 | A | 3/2008 |
| JP | 2011-14498 | A | 1/2011 |

* cited by examiner

*Primary Examiner* — Xuong Chung Trans
(74) *Attorney, Agent, or Firm* — Barley Snyder

(57) ABSTRACT

A terminal block is disclosed having a leaf spring, a contact, a cam member, and a spring member. The contact is positioned adjacent to the leaf spring and has a contact seat. The contact seat has a projection extending towards the leaf spring and is positionable in a hole of a ring terminal inserted into the terminal block. The cam member is in rotatable contact with the leaf spring, has a rotational axis extending in a direction of insertion of the ring terminal, and when in contact with the leaf spring, presses the leaf spring against the contact. The spring member is located closer to the leaf spring than the contact seat and biased against the inserted ring terminal.

9 Claims, 17 Drawing Sheets

(A)

(B)

(A)

(B)

(A)

(B)

TERMINAL BLOCK

CROSS-REFERENCE TO RELATED APPLICATION

This application claims priority under 35 U.S.C. §119(a)-(d) to Japanese Patent Application No. 2013-206345, filed on Oct. 1, 2013.

FIELD OF THE INVENTION

The present invention relates to a terminal block connecting a ring terminal terminated to a distal end of a cable.

BACKGROUND

Conventionally, a terminal block of a type in which screws are inserted into holes of ring terminals and the screws are fixed to threaded holes of contact seats is widely used. In these terminal blocks, to install the screws when they are completely detached from the contact seat, the screws need to be inserted into the holes of the ring terminals, and then screwed into the contact seats in order to fix the ring terminal. This multistep process results in a process-heavy workload required to mount the ring terminal.

Alternative designs of a terminal block of a type that can reliably fix ring terminals with fewer steps is desired. While several alternative designs have been developed to solve this long-felt need in the industry, none of these designs offers the reliability desired, while reducing the number of assembly steps.

For example, Japanese Patent Application No. 2000-306617 ("Reference 1") discloses a relay ground terminal for a residential distribution board. A ground wire is inserted into a housing, and a locking metal element is crimped to the ground wire by rotationally operating an operation lever. The operation lever is equipped with a cam face to drive an auxiliary member to the ground wire. While this design reduces the number of assembly steps, reliability is not increased, because the ring terminal can be pulled out when the ground wire is pulled with a sufficient force.

Japanese Patent Application No. 2007-165323 ("Reference 2") discloses an electrical terminal in that uses an operation cam to fasten a conductor, where the conductor is fastened through a pivoting action of the operation cam. The conductor is inserted into a through-hole, and the operation cam is rotationally operated to produce a camming action that fastens the conductor.

Further, Japanese Patent Application No. 2008-64266 ("Reference 3") discloses a terminal device in which a conductor is secured by insertion into a locking hole of a locking spring. A release lever having a cam is rotationally operated to fasten the conductor through the pivoting action of the cam spaceion.

Similarly to Reference 1, References 2 and 3 also suffer from the ring terminal being pulled out accidentally when the conductor is pulled on. Further, since the insertion direction of the electric wire is different from the direction of a rotation axis of the cam, it is difficult to achieve a low profile terminal block.

Therefore, a terminal block is needed to reliably hold a conductor and to do so using a minimum number of steps.

SUMMARY

A terminal block has a leaf spring, a contact, a cam member, and a spring member. The contact is positioned adjacent to the leaf spring and has a contact seat. The contact seat has a projection extending towards the leaf spring and is positionable in a hole of a ring terminal inserted into the terminal block. The cam member is in rotatable contact with the leaf spring, has a rotational axis extending in a direction of insertion of the ring terminal, and when in contact with the leaf spring, presses the leaf spring against the contact. The spring member is located closer to the leaf spring than the contact seat and biased against the inserted ring terminal.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
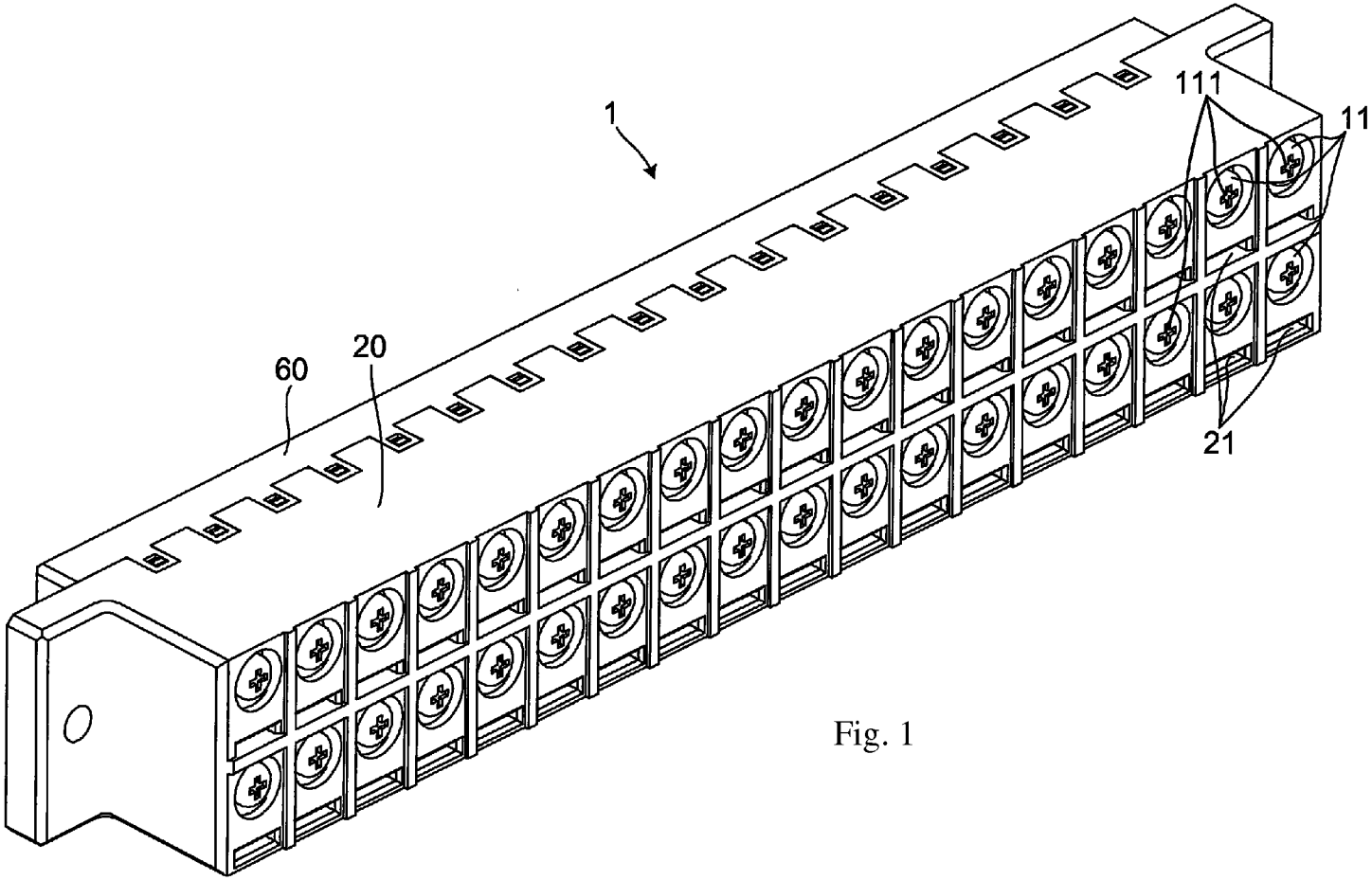
FIG. 1 is a perspective view of a terminal block.

In an embodiment shown in FIG. 1, a terminal block 1 has a front housing 20 coupled to a rear housing 60. Heads 11 of thirty-six cam members 10 (described later) are arranged in upper and lower rows positioned in the front housing 20. A cross-shaped groove 111 receiving a screwdriver is formed in the head 11, also known as a "Phillip's head". A terminal receiving space 21 receiving a ring terminal 72 (described later) is provided below the respective heads 11 in the front housing 20.

Figure 2:
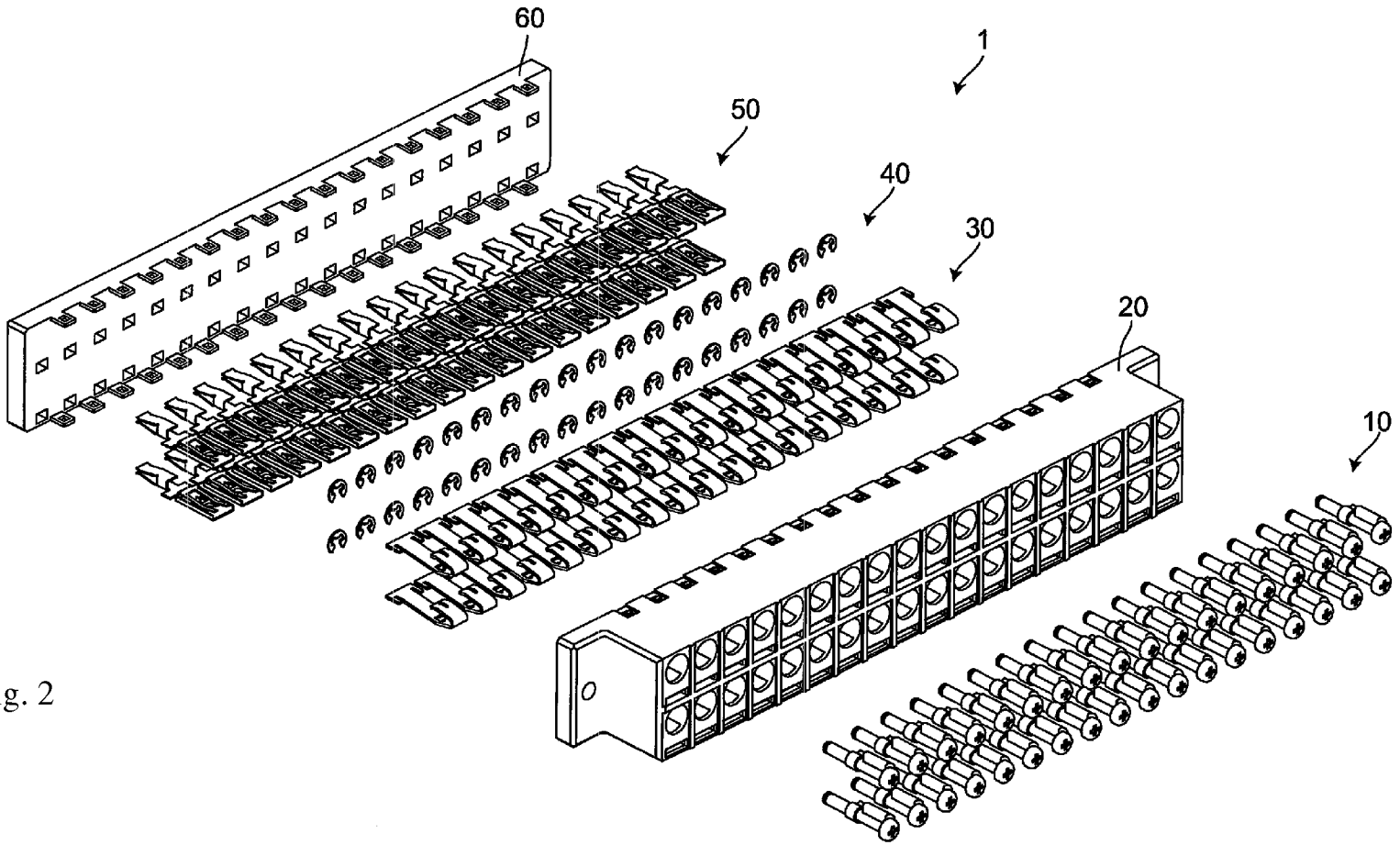
FIG. 2 is an exploded perspective view of the terminal block shown in FIG. 1.

In an embodiment shown in FIG. 2, the terminal block 1 is shown having the cam members 10, the front housing 20, leaf springs 30, C-rings 40, contacts 50, and the rear housing 60.

Figure 3:
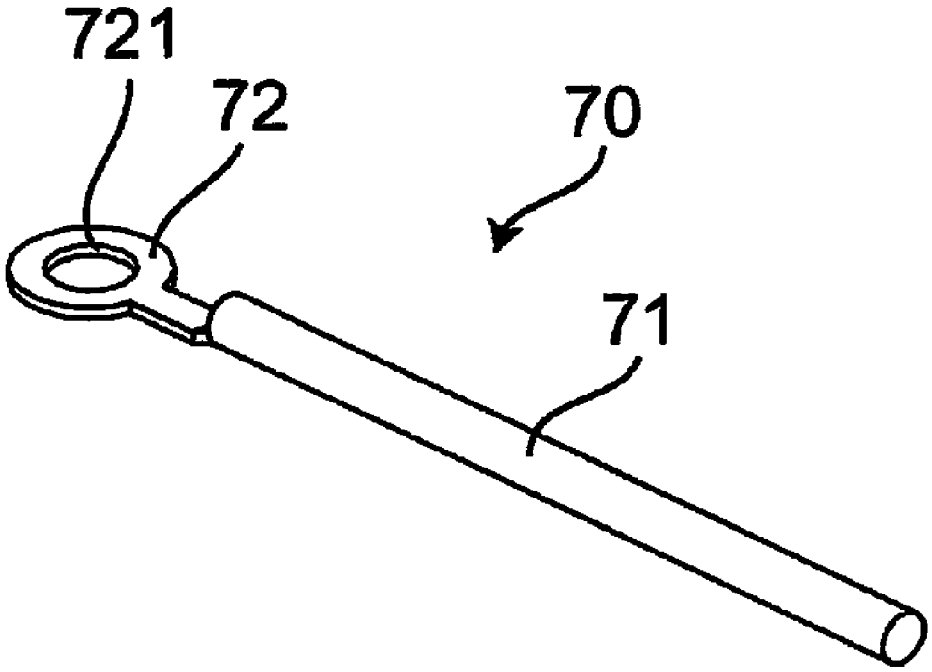
FIG. 3 is a perspective view of a distal end of a cable with a ring terminal.

In the embodiment shown in FIG. 3, a cable assembly 70 includes a cable 71 and the ring terminal 72 disposed at a distal end of the cable 71. A hole 721 is formed in an approximate center of the ring terminal 72.

The terminal block 1 receives and fixes the ring terminal 72 of the cable assembly 70.

Figure 4:
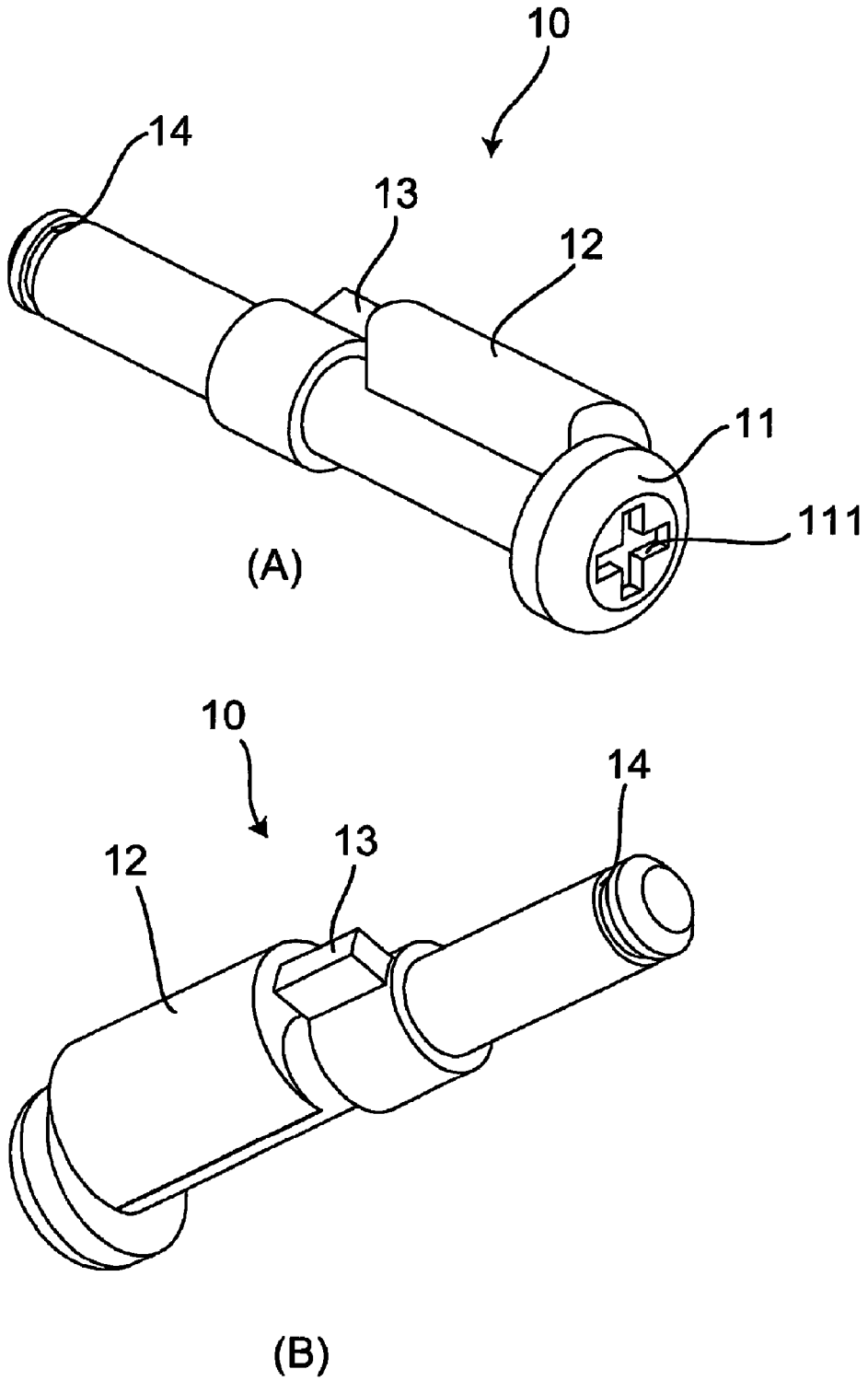
FIG. 4 is a perspective view of a cam member.

In the embodiment shown in FIGS. 4(A) and 4(B), the cam member 10 has a unidimensionally-extending overall shape, with a rotational axis positioned along the length. The cam member 10 includes the head 11 in which a cross-shaped groove 111, which has been described with reference to FIG. 1, is formed. A screwdriver (not shown) is inserted into this cross-shaped groove 111 to rotate the cam member 10.

The cam member 10 further includes a rotating cam 12 positioned directly behind the head 11. The rotating cam 12 presses the leaf spring 30 against the contact 50 when the cam member 10 is rotationally operated.

A projection 13 is positioned upright directly behind the rotating cam 12 on the cam member 10. The projection 13 functions to abut on a stopper 25 (see FIGS. 10 and 11) of the front housing 20 when this cam member 12 is rotated, and block the cam member 12 from rotating any further.

A circumferential groove 14 circling around the cam member 10 is formed in a rearmost end of the cam member 10, opposite the head 11. The structure of the circumferential groove 14 is such that the C-ring 40 is fitted in the circumferential groove 14 to prevent the cam member 10 from slipping out from the front housing 20.

The front housing 20 is provided with the terminal receiving spaces 21 which have been described with reference to FIG. 1. The contact 50, inserted through a rear face of the front housing 20, is positioned in the terminal receiving space 21 such that when the ring terminal 72 (see FIG. 3) is inserted from the terminal receiving space 21, the contact 50 receives the ring terminal 72.

A cam member receiving space 22 is formed above each terminal receiving space 21 of the front housing 20. The cam member 10 is inserted into the front housing 20 from the cam member receiving space 22, and positioned in the front housing 20 with the head 11 of the cam member 10 exposed as shown in FIG. 1.

Figure 9:
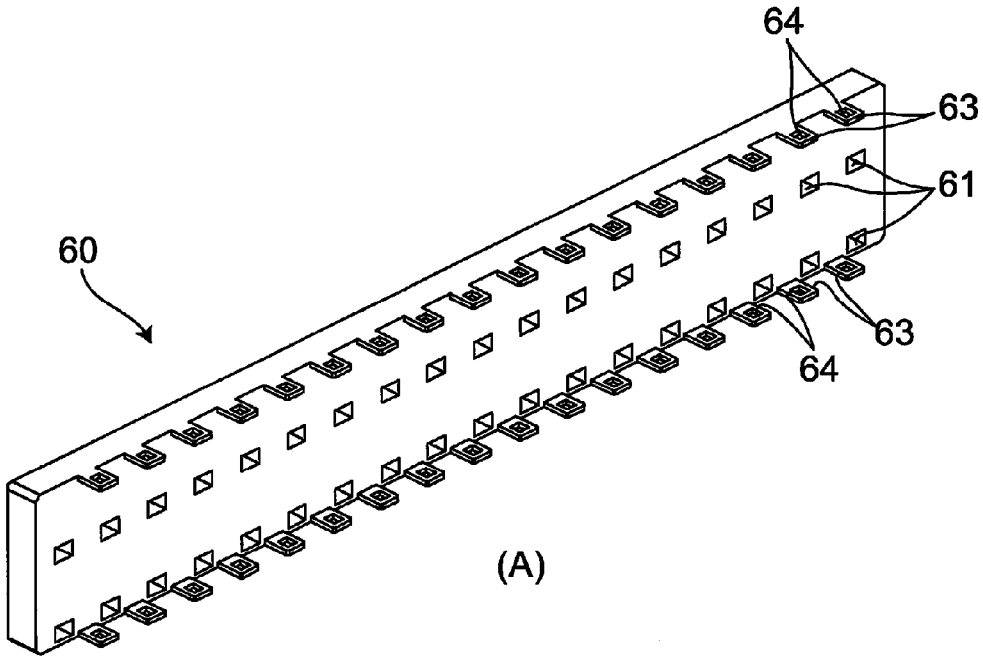
FIG. 9 is a perspective view of a rear housing.
Figure 9:
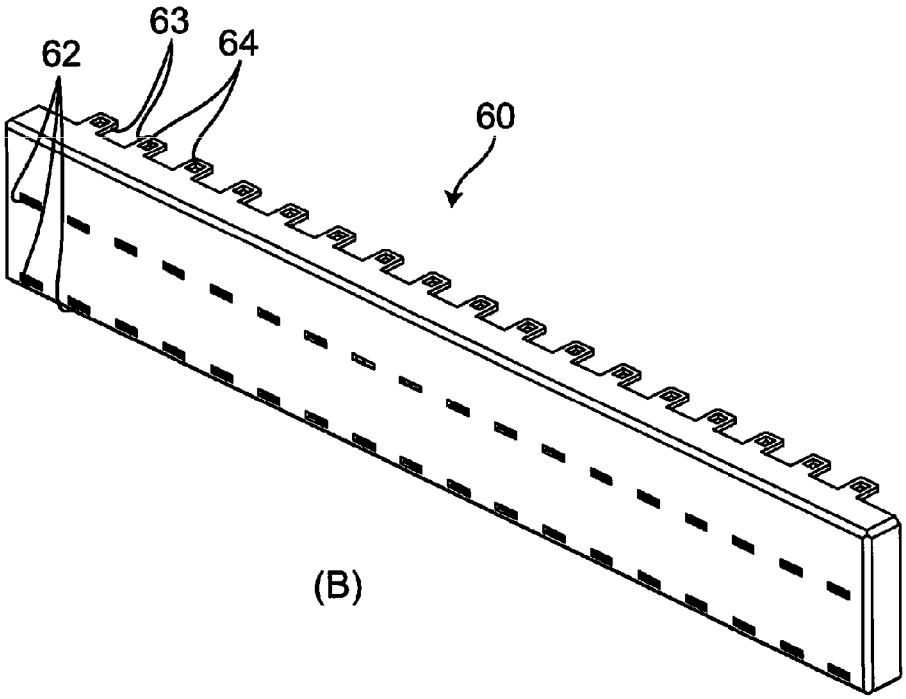

A plurality of grooves 23 are provided in a rear end of the housing 20 for coupling with the rear housing 60 (see FIGS. 1 and 2), and a coupling projection 24 is formed in the groove 23 for being positioned in a coupling hole 64 of the rear housing 60 (see FIG. 9).

Figure 6:
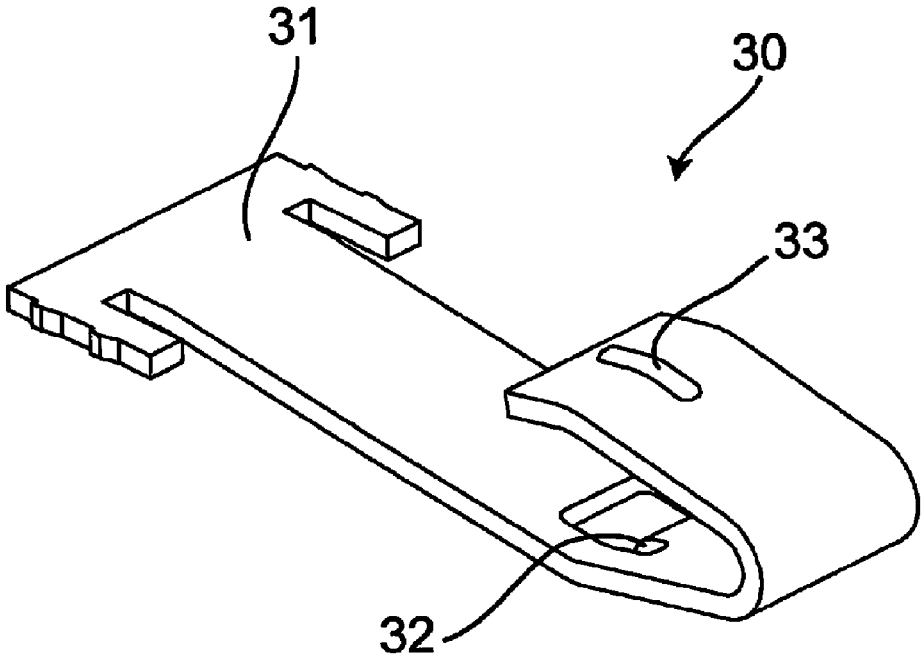
FIG. 6 is a perspective view of a leaf spring.
Figure 6:
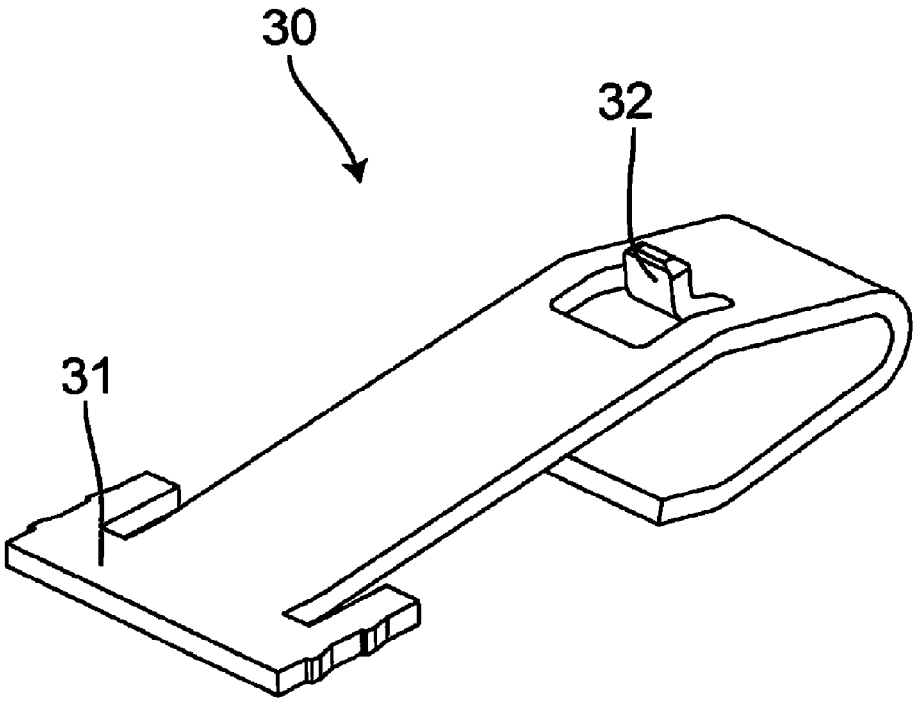

In the embodiment shown in FIGS. 6(A) and 6(B), the leaf spring 30 extends as a cantilever from a base 31, is folded back towards the spring base 31, and extending approximately half of the length back towards the base 31. The spring base 31 will be press-fitted in the front housing 20.

The leaf spring 30 is positioned adjacent to the contact 50 inside the front housing 20, between the contact 50 and the cam member 10.

The leaf spring 30 has a extending member 32 cut-and-bent toward the contact 50. The function of the extending member 32 is described below. A bead 33 projecting from the leaf spring 30 toward the cam member 10 is formed on the folded back portion of the leaf spring 30 that extends toward the base 31. The function of the bead 33 is also described below.

Figure 7:
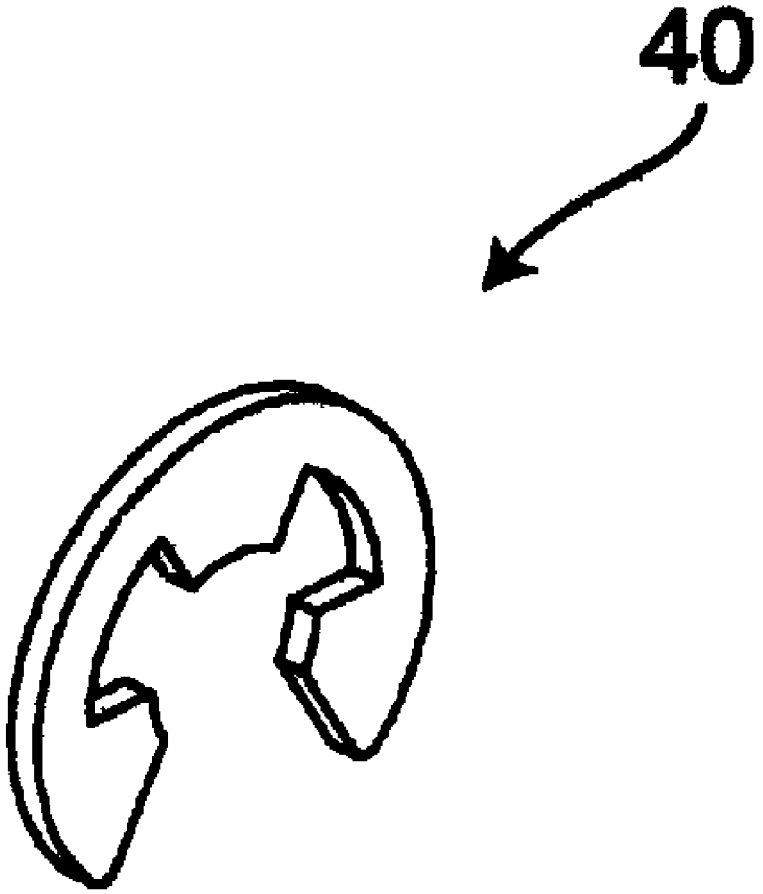
FIG. 7 is a perspective view of a C-ring.
Figure 17:
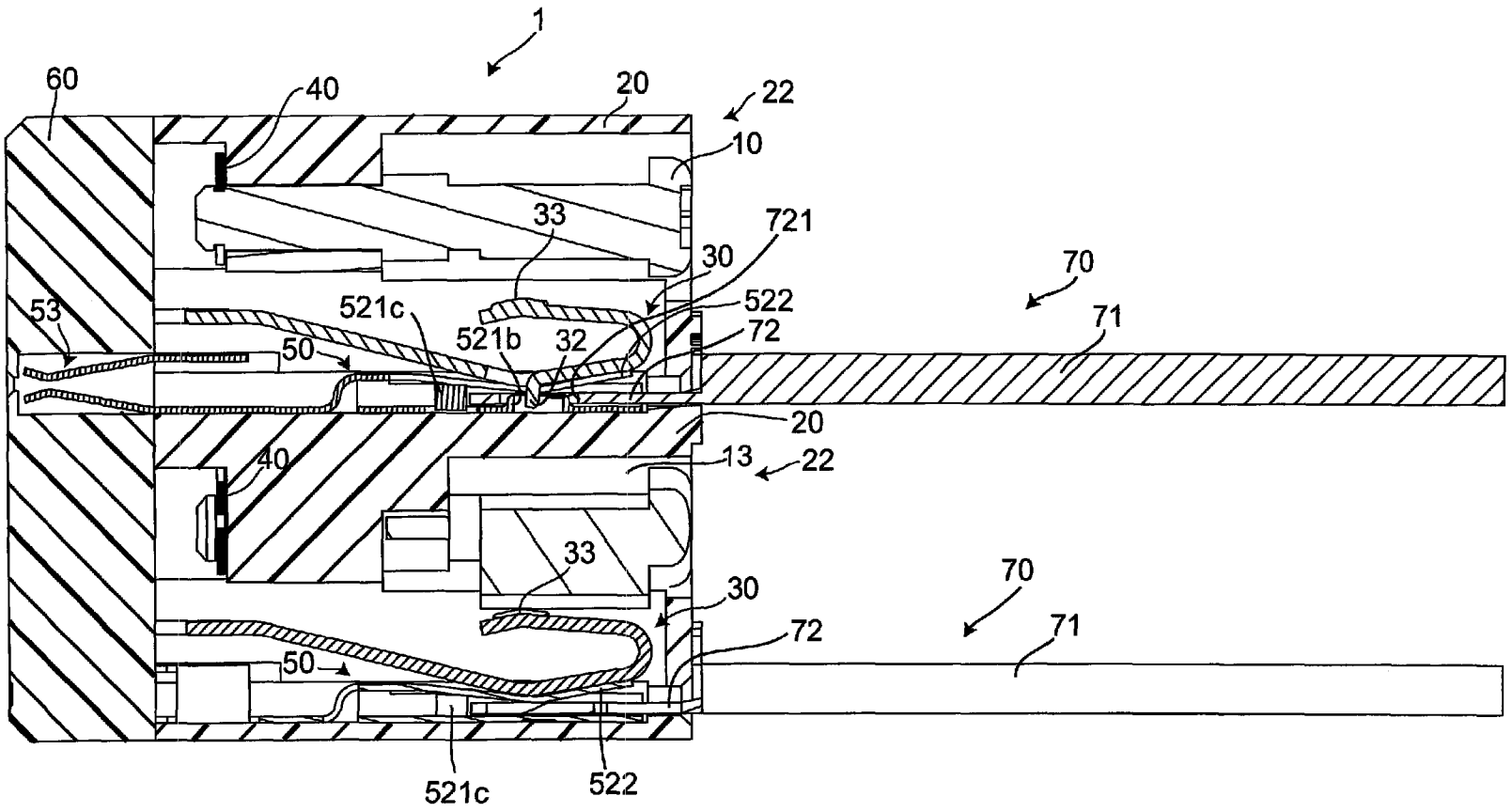
FIG. 17 is a sectional view of the terminal block taken along arrow C-C shown in FIG. 16.

In an embodiment shown in FIGS. 2, 7, and 17, the C-ring 40 is positioned in the rearmost circumferential groove 14 of the cam member 10, when the cam member 10 is inserted in the cam member receiving space 22 of the front housing 20. The C-ring 40 functions to prevent the cam member 10 from slipping out of the front housing 20.

Figure 8:
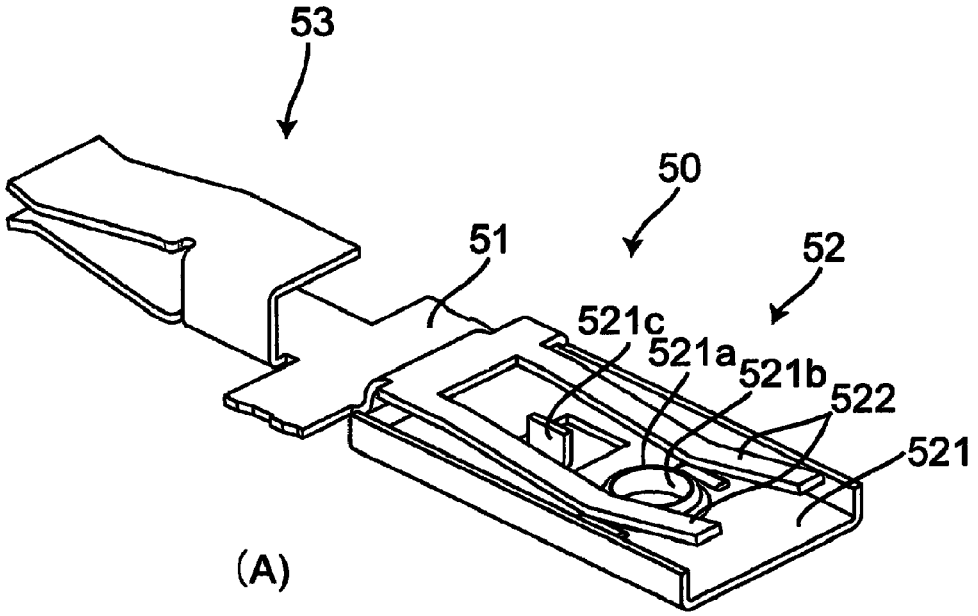
FIG. 8 is a perspective view of a contact.
Figure 8:
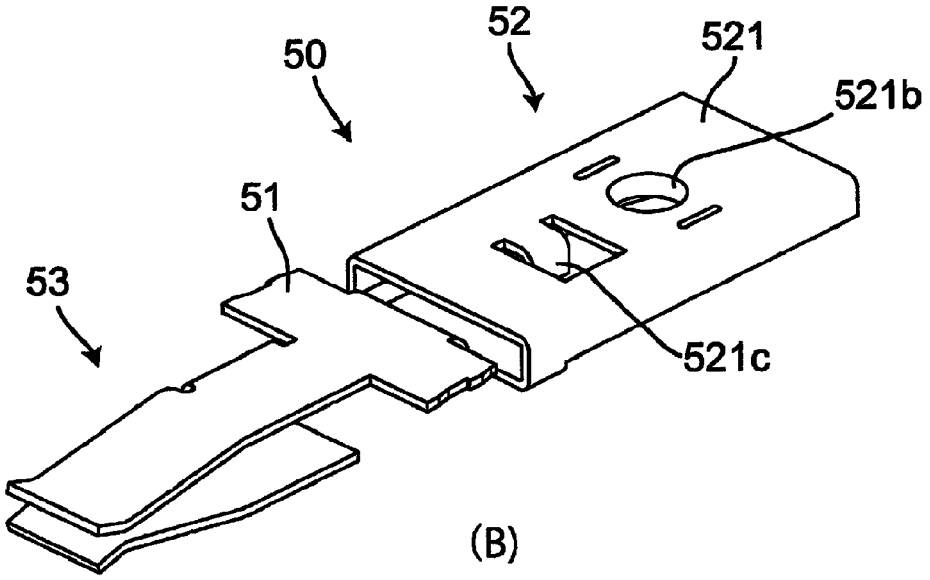

In the embodiment shown in FIGS. 8(A) and 8(B), the contact 50 is provided with a first contact 52 connected to a contact base 51, and a second contact 53 positioned adjacent to the contact base 51. The contact base 51 is press-fitted into the front housing 20.

The first contact 52 is a positioned in the front housing 20 and contacts the ring terminal 72 of the cable assembly 70 shown in FIG. 3. The second contact 53 is a positioned in both the front housing 20 and the rear housing 60 in a bridging manner and contacts a contact of another device electrically conducted with the cable with the ring terminal 70 via the terminal block 1.

As shown in FIGS. 8(A) and 8(B), the first contact 52 has a contact seat 521 and a spring member 522. An annular projection 521*a* is positioned on the contact seat 521 and extends toward the leaf spring 30 when assembled to the front housing 20. When the ring terminal 72 is inserted, the projection 521*a* engages the hole 721 to firmly secure the cable assembly 70.

Further, the contact seat 521 has a contact hole 521*b* positioned in an approximate center of the projection 521*a*. The contact hole 521*b* catches the extending member 32 formed in the leaf spring 30.

A contact stopper 521 c composed of a cut-and-bent piece positioned adjacent to the projection 521*a* of the contact seat 521. The contact stopper 521*c* abuts a distal end of an inserted ring terminal 72, thereby restricting the position in an insertion direction of the ring terminal 72 such that the ring terminal 72 unable to be inserted any further.

The spring member 522 is positioned closer to the leaf spring 30 than the contact seat 521 (see FIG. 13), and functions to bias the inserted ring terminal 72 to the contact seat 521.

When the ring terminal 72 is inserted between the contact seat 521 and the spring member 522, the spring member 522 presses the ring terminal 72 against the contact seat 521, while the ring terminal 72 rides over the projection 521*a* until the distal end of the ring terminal 72 abuts against the contact stopper 521*c*. At this time, the projection 521*a* is positioned in the hole 721 of the ring terminal 72 and secured thereto. When the projection 521*a* is inserted into the hole 721, a clicking sound and vibration is produced, alerting a user that the ring terminal 72 has been fully inserted and is retained in the terminal block 1.

The spring member 522 is bifurcated, having a folk-like shape, and extends along both sides of the projection 521*a*, such that the projection 521*a* is positioned between the spring member 552. The bifurcated structure of the spring member 522 ensures that both sides of the hole 721 of the ring terminal 72 are pressed against the contact seat 521. In addition, the folk-like shape of the spring member 522 causes the contact hole 521*b* to be assessable to the extending member 32 of the leaf spring 30. The extending member 32 is positioned in the contact hole 521*b*.

In the embodiment shown in FIG. 9, the rear housing 60 includes openings and mating contact insertion spaces 62. The openings 61 are arranged in upper and lower two rows formed in a front of the rear housing 60. The mating contact insertion spaces 62 are formed in a back face of the rear housing, each of which communicates with one of the openings 61, such that the opening 61 and the mating contact insertion space 62 form a through-hole. A portion of the second contact 53 is positioned in the opening 61. A mating contact of a device (not shown) connected electrically to the cable 71 with the ring terminal 70, via the terminal block 1, is inserted into the mating contact insertion space 62. This inserted mating contact is electrically connected to the second contact 53 of the contact 50 of the terminal block 1.

Figure 5:
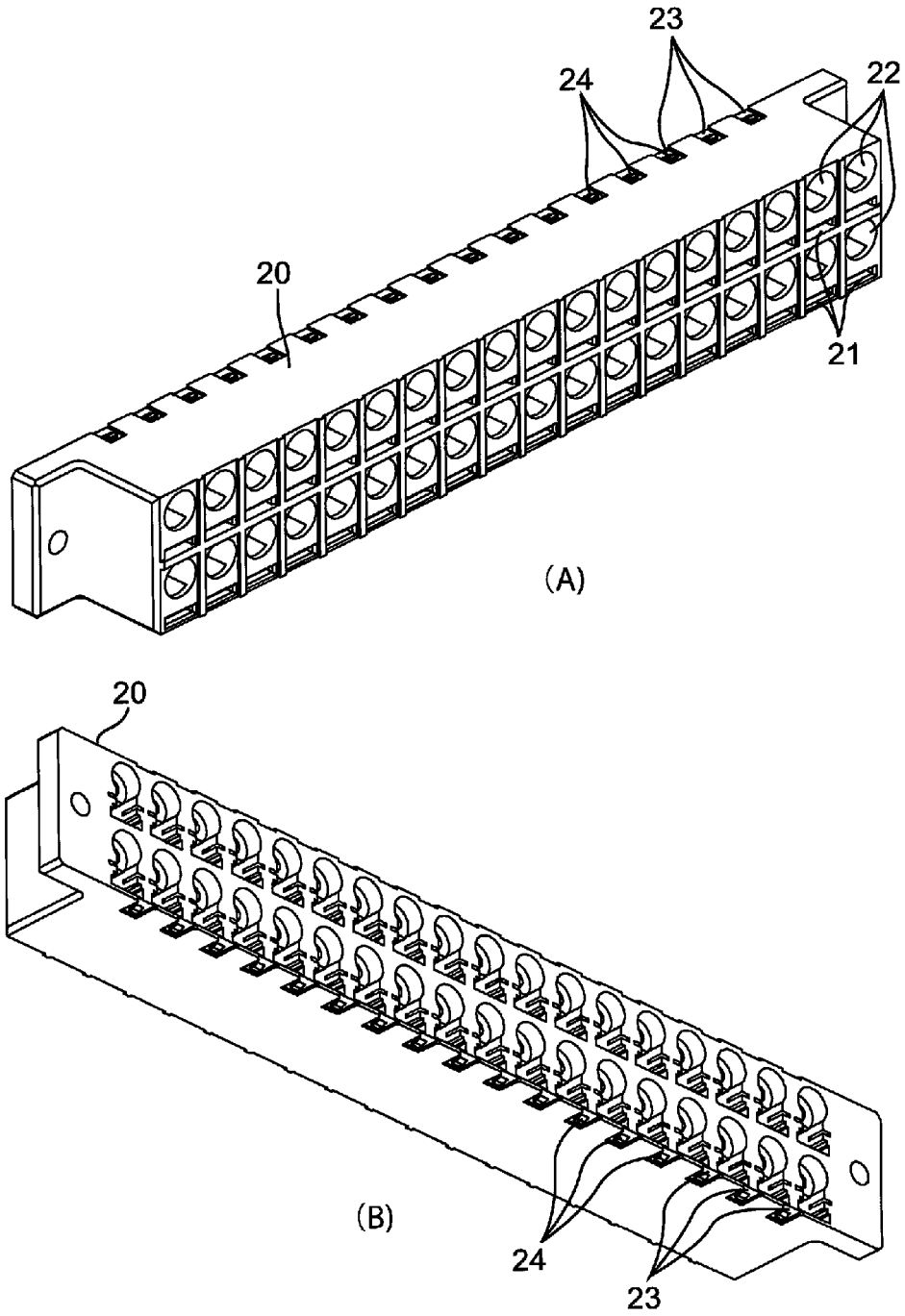
FIG. 5 is a perspective view of a front housing.

A plurality of locking tabs 63 formed on the rear housing 60, and are positioned in a row along an upper and a lower edge of the rear housing 60. Each locking tab 63 has a groove projection receiving hole 64. The front housing 20 has a plurality of complementary locking tab receiving grooves 23, each locking tab receiving groove 23 having a groove projection 24. When the locking tabs 63 are inserted into the locking tab receiving grooves 23, and the groove projection 24 (see FIG. 5) is inserted into the groove projection receiving hole 64 to couple the front housing 20 and the rear housing 60 are together.

Figure 10:
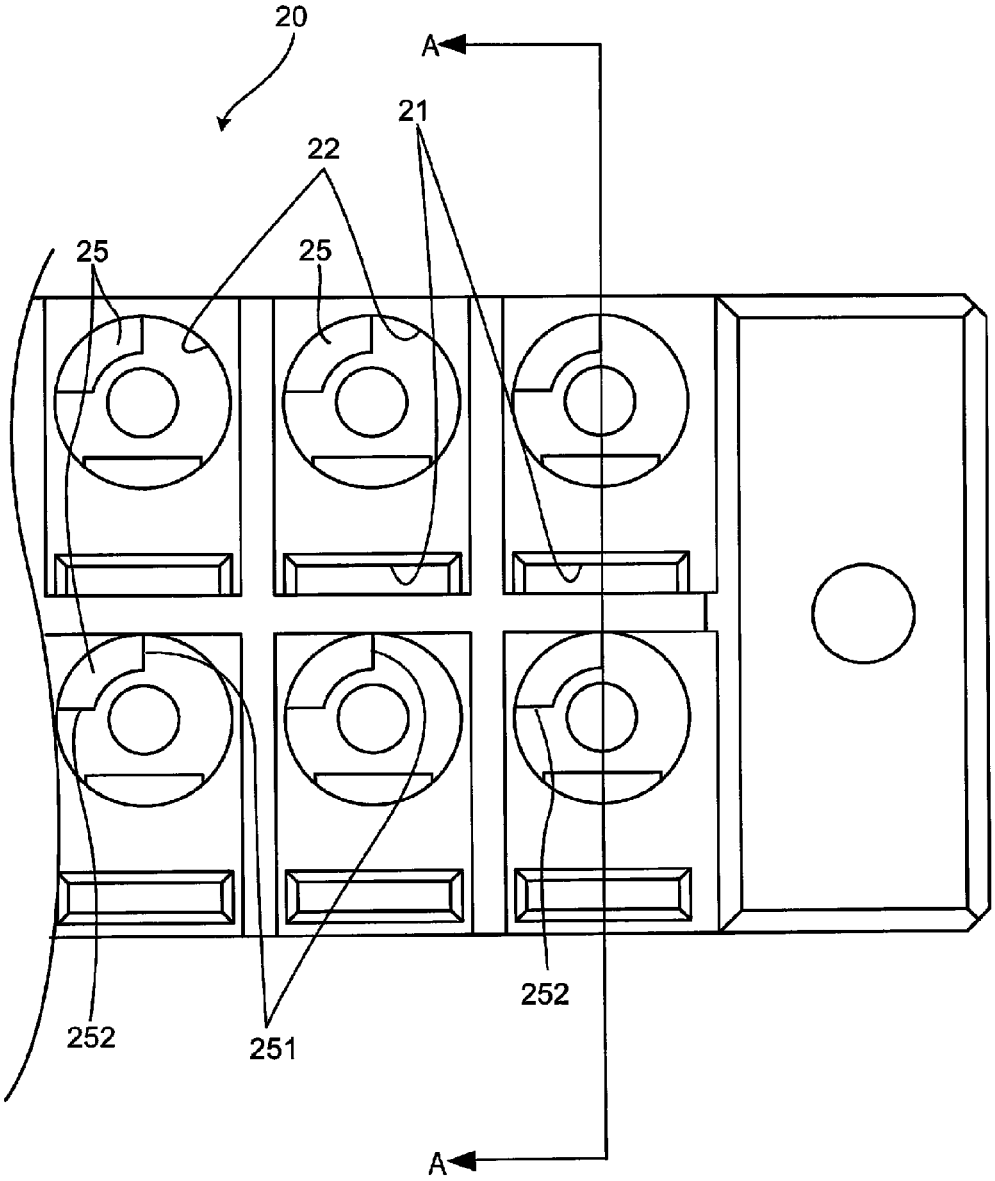
FIG. 10 is an enlarged front view showing a part of the front housing.
Figure 11:
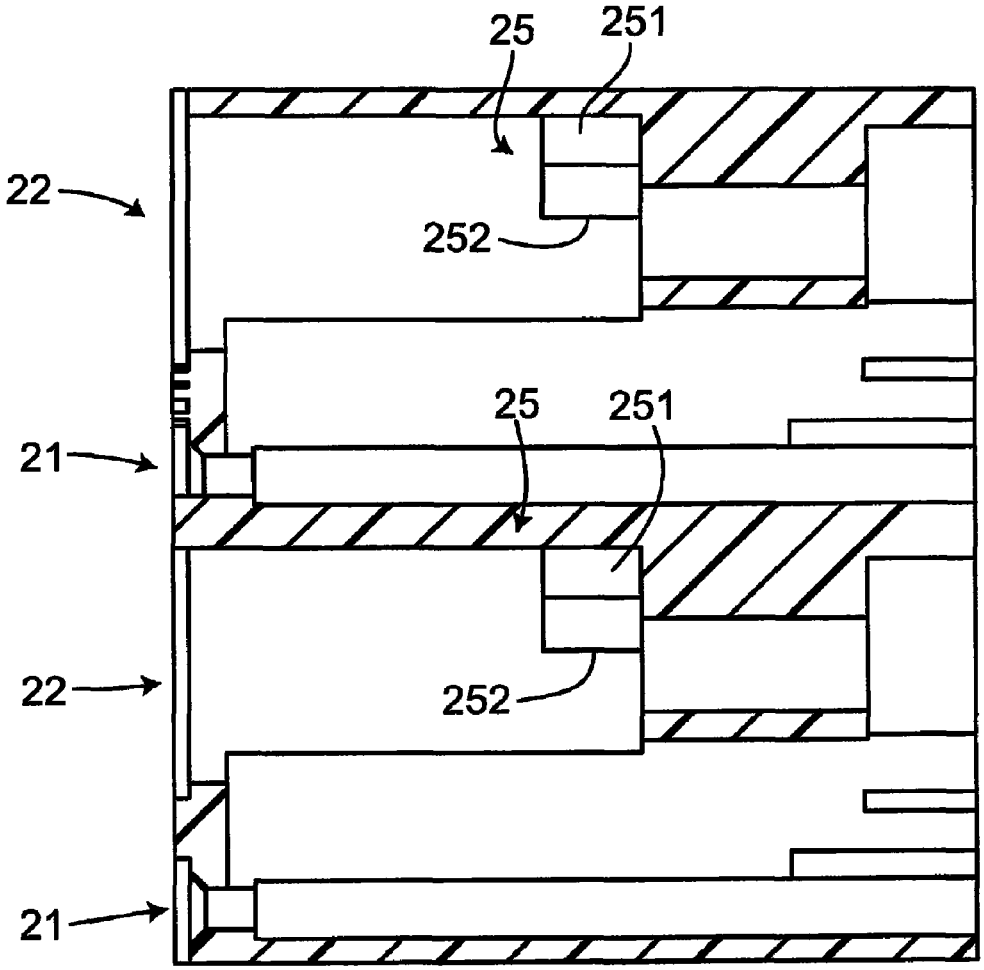
FIG. 11 is a sectional view of the front housing taken along arrow A-A shown in FIG. 10.

In the embodiment shown in FIG. 10, the terminal receiving spaces 21 are arranged in upper and lower rows in the front housing 20, and the cam member receiving spaces 22 are each arranged above the terminal receiving space 21. The stopper 25 projects into the cam member receiving space 22. The stopper 25 functions to restrict the degree of the cam member 10 rotation such that rotational degrees of freedom are limited are restricted to a predetermined amount. Each stopper 25 has a first abutting face 251 and a second abutting face 252.

When the cam member 10 is rotated in a direction of releasing the leaf spring 30 from the state of being pressed against the contact 50, the first abutting face 251 abuts against the projection 13 of the cam member 10, thereby stopping the cam member 10 from rotating. The position of the cam member 10 as shown in FIG. 12 is defined as a "released position".

When the cam member 10 is rotated in a direction to press the leaf spring 30 against the contact 50, the second abutting face 252 contacts the projection 13 of the cam member 10, stopping the rotation of the cam member 10. This position of the cam member 10 is defined as a "pressed position".

Figure 12:
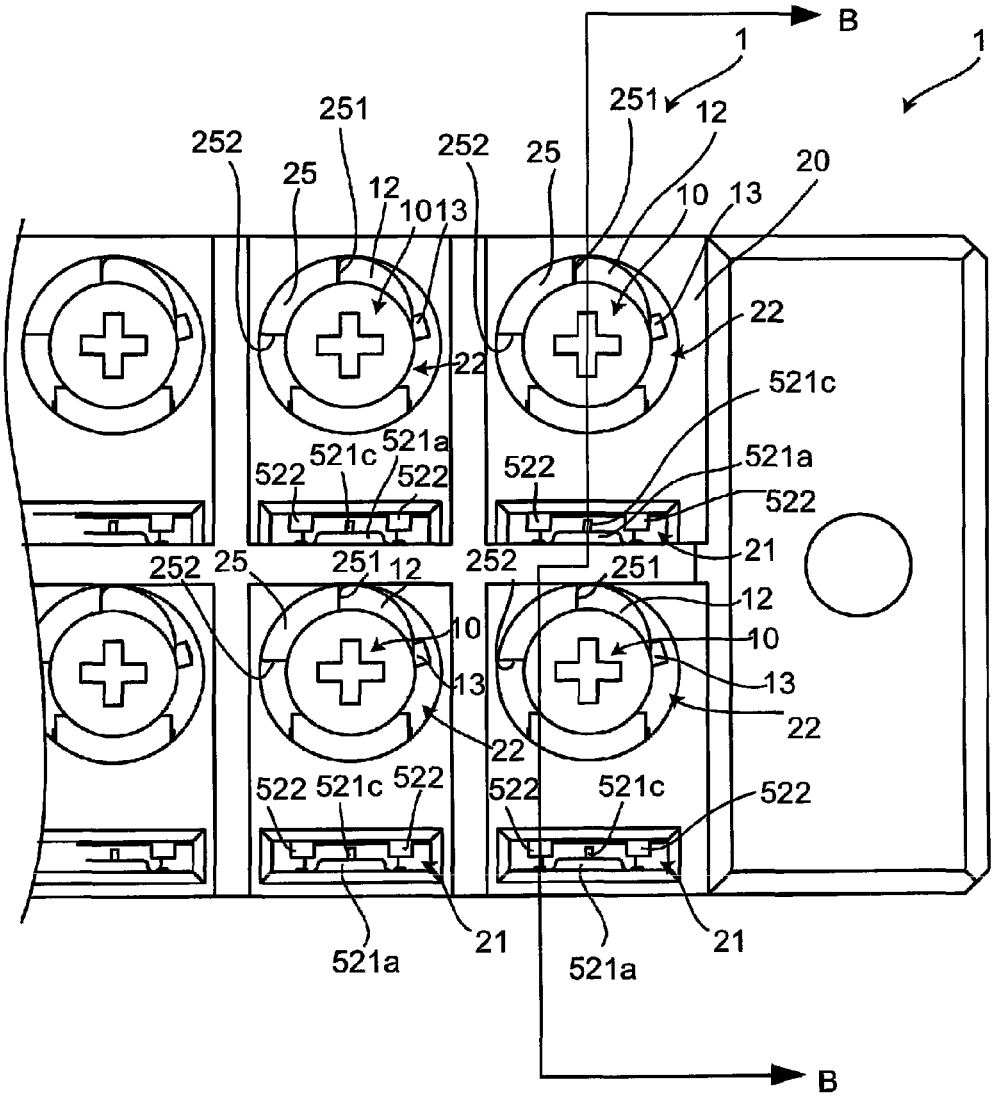
FIG. 12 is an enlarged front view showing a part of the terminal block after assembled.

In the embodiment shown in FIG. 12, the projection 521*a*, the contact stopper 521*c*, and the spring member 522 are positioned in the terminal receiving space 21, where the cam member 10 is in the released position.

Figure 13:
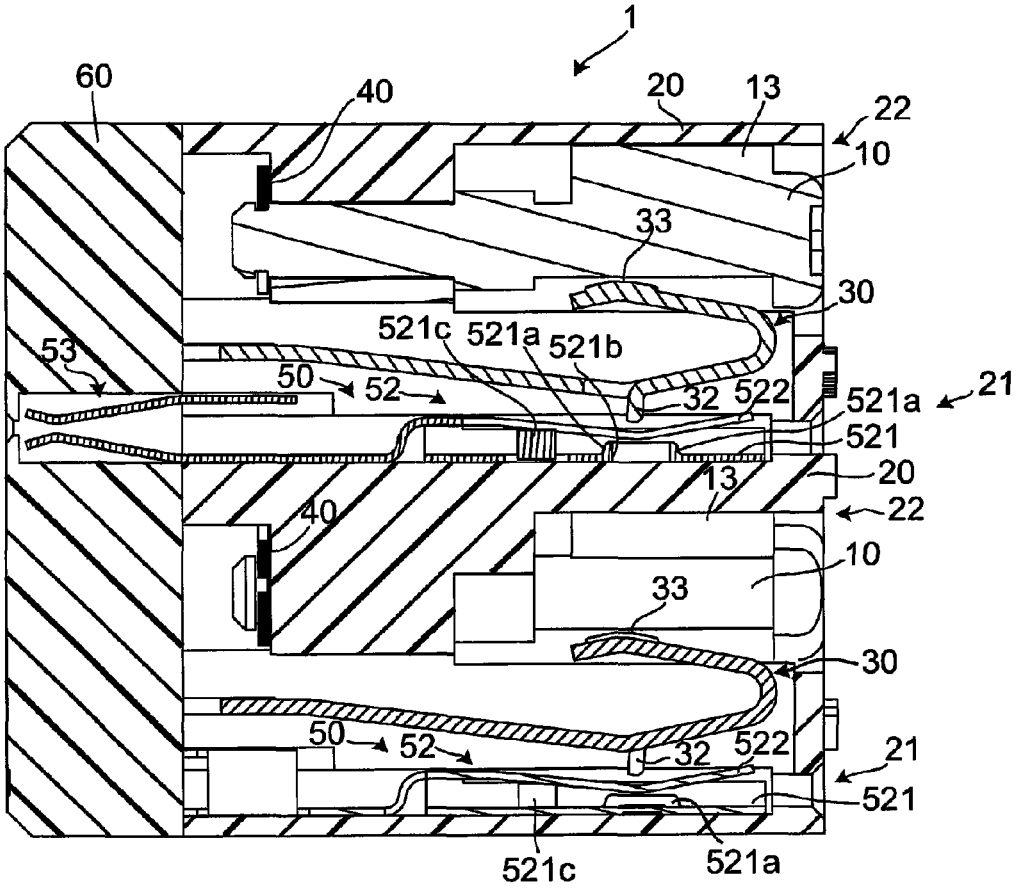
FIG. 13 is a sectional view of the terminal block taken along arrow B-B shown in FIG. 12.

In the embodiment shown in FIG. 13, the leaf spring 30 is positioned away from the contact 50, with the contact 50 being ready to receive the ring terminal 72.

Figure 14:
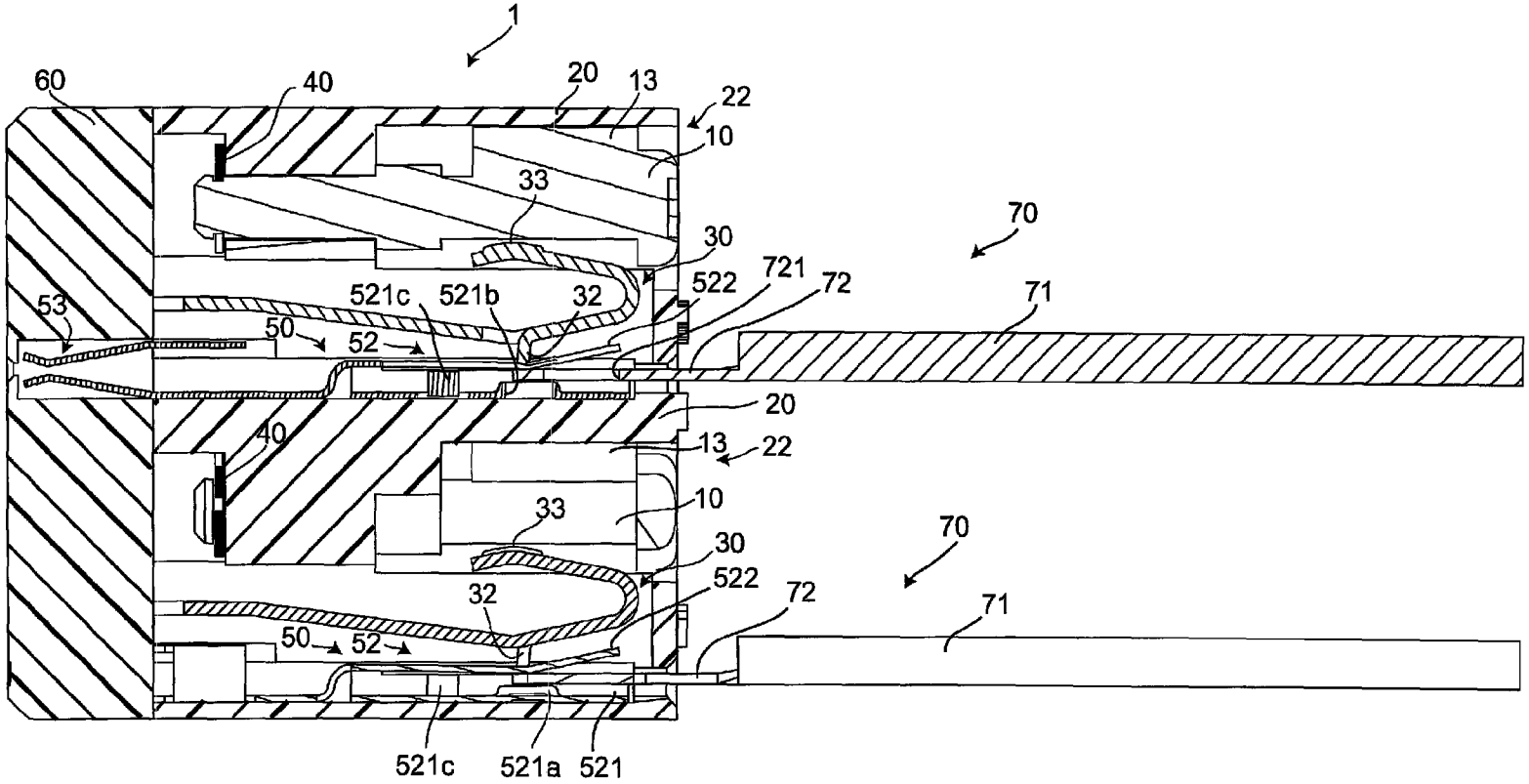
FIG. 14 is a sectional view taken along arrow B-B shown in FIG. 12 when the ring terminal at the distal end of the cable with the ring terminal is inserted halfway.

In the embodiment shown in FIG. 14, the ring terminal 72 is partially inserted, and the spring member 522 of the contact 50 has been displaced by the ring terminal 72.

Figure 15:
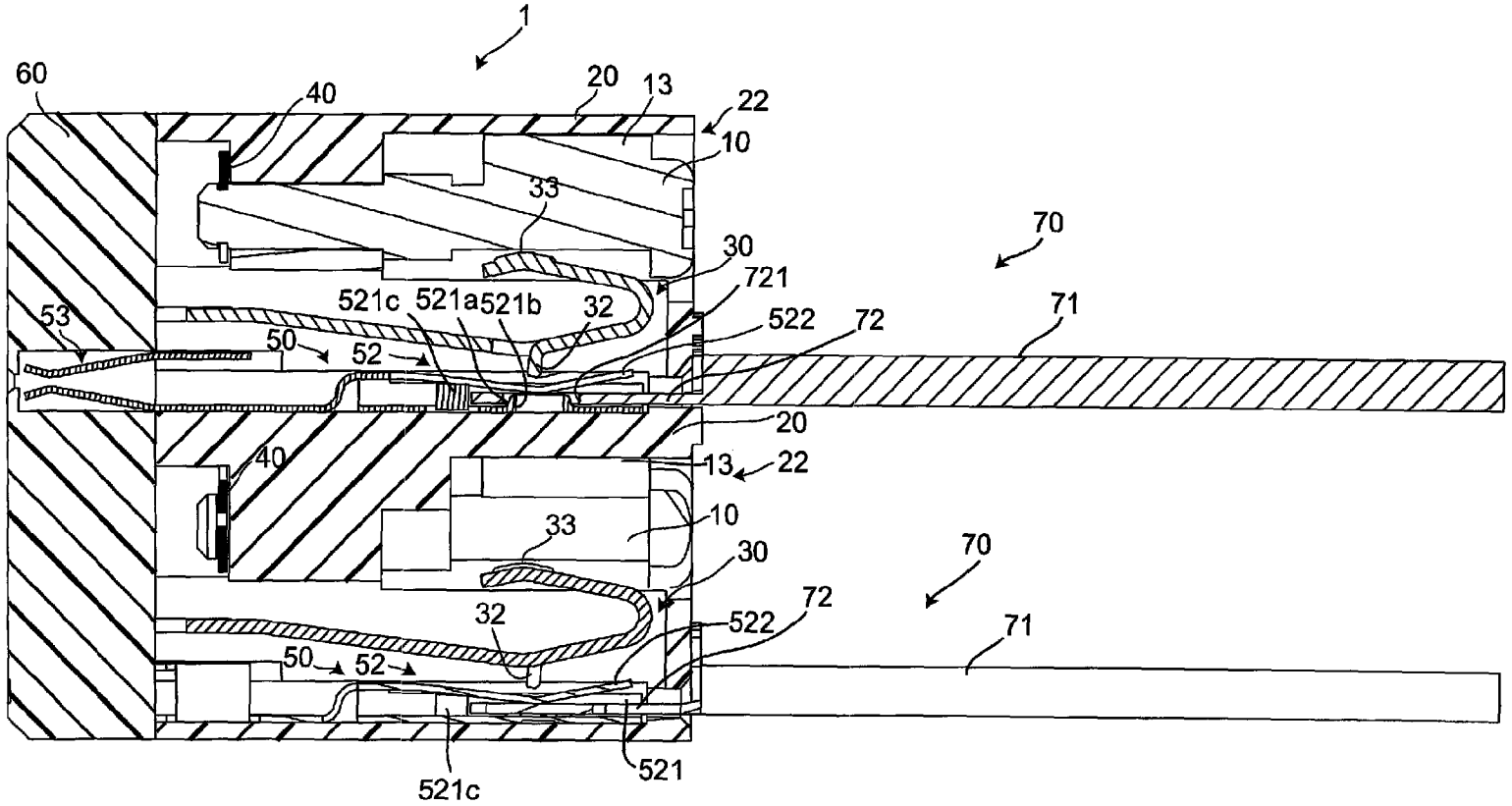
FIG. 15 is a sectional view taken along arrow B-B shown in FIG. 12 when the ring terminal is inserted to a predetermined position.

In the embodiment shown in FIG. 15, the distal end of the inserted ring terminal 72 has contacted the contact stopper 521*c*, and the projection 521*a* of the contact seat 521 of the contact 50 has been inserted into the hole 721 of the ring terminal 72. Since the projection 521*a* of the contact seat 521 of the contact 50 is inserted into the hole 721 of the ring terminal 72, the ring terminal 72 is prevented from disengaging and ejecting from the terminal block 1 if an outward force is placed on the cable 71.

Figure 16:
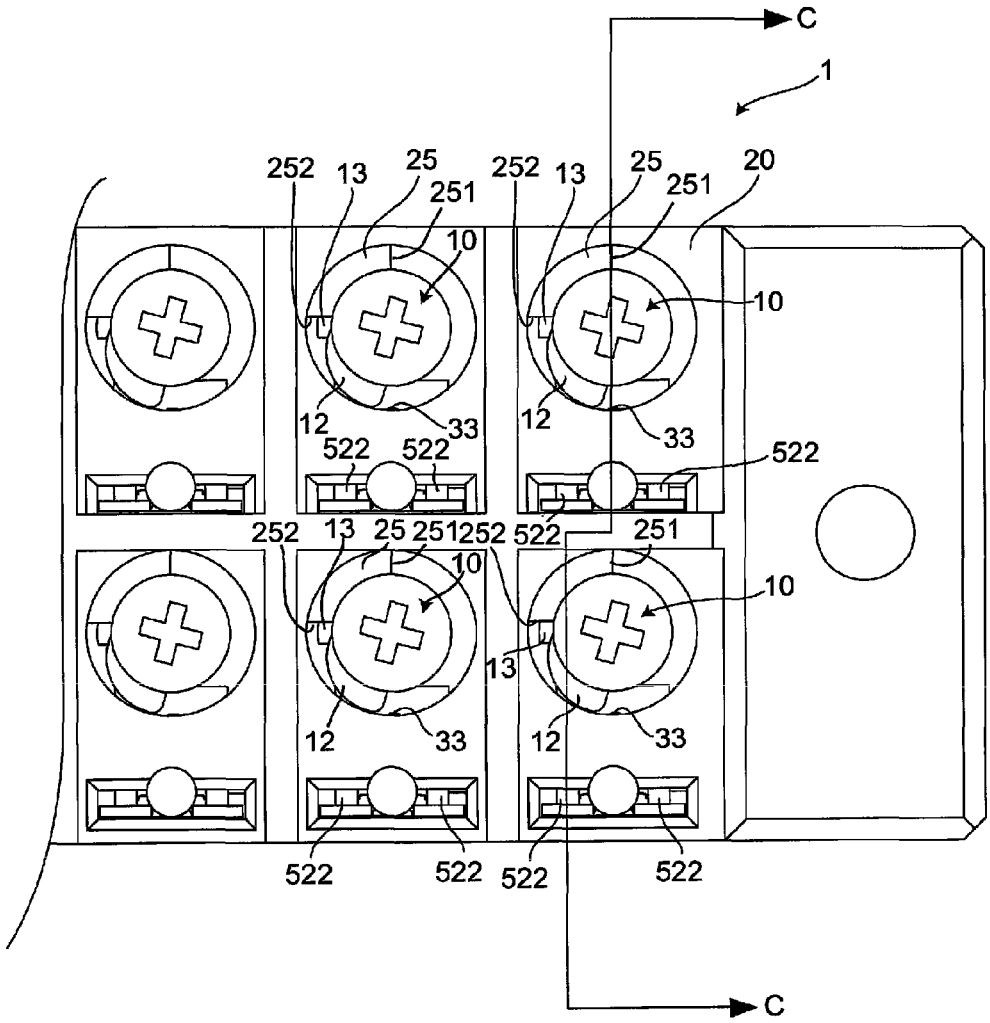
FIG. 16 is an enlarged front view showing a part of a terminal block, like FIG. 12.

In the embodiments shown in FIGS. 16 and 17, the cam member 10 has been rotated from the released position shown in FIG. 12 to the pressed position. In the pressed position, the projection 13 of the cam member 10 has contacted the second abutting face 252 of the stopper 25. As the cam member 10 is rotated to the pressed position, the rotating cam 12 of the cam member 10 rides over the bead 33 (also see FIG. 6(A)) formed on the leaf spring 30. The bead 33 increases the force necessary to rotate the cam member 10 from the pressed position to the released position, thus preventing the cam member 10 in the pressed position from rotating accidentally to the released position.

Additionally, since the leaf spring 30 is pressed against the contact 50 by the rotating cam 12 while in the pressed position, and the extending member 32 of the leaf spring 30 is positioned into the contact hole 521*b* of the contact seat 521 the ring terminal 72 is further prevented from disengaging and ejecting from the terminal block 1 if an outward force is placed on the cable 71.

To remove the ring terminal 72 from the terminal block 1, the cam member 10 is rotated from the pressed position to the released position. The rotation of the cam member contact 50 releases the pressure of the leaf spring 30, thus displacing the extending member 32 of the leaf spring 30 is from the contact hole 521*b*. In this manner, the cam member 10 is rotated to the released position, and the ring terminal 72 can be pulled out of the terminal block 1 by pulling the cable assembly 70.

What is claimed is:

1. A terminal block comprising:

a leaf spring;

a contact positioned adjacent to the leaf spring and having a contact seat with a projection extending towards the leaf spring and positionable in a hole of a ring terminal inserted into the terminal block;

a cam member in rotatable contact with the leaf spring, having a rotational axis extending in a direction of insertion of the ring terminal, and when in contact with the leaf spring, pressing the leaf spring against the contact; and a spring member located closer to the leaf spring than the contact seat, and biased against the inserted ring terminal.

2. The terminal block of claim 1, wherein the contact seat has a contact hole facing the leaf spring.

3. The terminal block of claim 2, wherein the contact hole is positioned in an approximate center of the projection.

4. The terminal block of claim 3, wherein the spring member is bifurcated.

5. The terminal block of claim 4, wherein the spring member extends along opposing sides of the projection.

6. The terminal block of claim 2, wherein the leaf spring has an extending member positioned in the contact hole when the leaf spring is pressed against the contact by the cam member.

7. The terminal block of claim 1, further comprising a bead positioned on the leaf spring and projecting towards the cam member.

8. The terminal block of claim 7, wherein the cam member contacts the bead when in rotatable contact with the leaf spring.

9. The terminal block of claim 8, wherein a frictional force between the cam member and the leaf spring increases when the cam member contacts the bead as the cam member rotates.

* * * * *